US009033443B2

(12) United States Patent
Usui

(10) Patent No.: US 9,033,443 B2
(45) Date of Patent: May 19, 2015

(54) LIQUID EJECTION APPARATUS AND CONTROL METHOD FOR LIQUID EJECTION APPARATUS

(71) Applicant: Seiko Epson Corporation, Tokyo (JP)

(72) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 93 days.

(21) Appl. No.: 13/972,245

(22) Filed: Aug. 21, 2013

(65) Prior Publication Data

US 2014/0055513 A1 Feb. 27, 2014

(30) Foreign Application Priority Data

Aug. 24, 2012 (JP) ..... 2012-184951

(51) Int. Cl.
*B41J 2/07* (2006.01)
*B41J 2/045* (2006.01)

(52) U.S. Cl.
CPC ..... *B41J 2/07* (2013.01); *B41J 2/04521* (2013.01); *B41J 2/04546* (2013.01); *B41J 2/04581* (2013.01); *B41J 2/04588* (2013.01); *B41J 2/04595* (2013.01); *B41J 2/04596* (2013.01)

(58) Field of Classification Search
USPC ..... 347/5, 9, 10, 11, 12, 13, 14
See application file for complete search history.

(56) References Cited

U.S. PATENT DOCUMENTS

| | | | | |
|---|---|---|---|---|
| 6,328,395 | B1 * | 12/2001 | Kitahara et al. | 347/9 |
| 7,467,835 | B2 * | 12/2008 | Gao et al. | 347/8 |
| 2002/0158926 | A1 * | 10/2002 | Fukano | 347/11 |
| 2005/0270317 | A1 * | 12/2005 | Gao et al. | 347/8 |

FOREIGN PATENT DOCUMENTS

| | | |
|---|---|---|
| JP | 2007-210234 A | 8/2007 |
| JP | 2009-056778 A | 3/2009 |

* cited by examiner

*Primary Examiner* — Huan Tran

(57) ABSTRACT

A printer controller outputs plural drive signals including respective series of drive pulses, the timing points of which are different from one another, to a head control unit side, and outputs a multiplexed signal resulting from multiplexing change signals corresponding to the respective drive signals to a head control unit side, and the head control unit includes a control signal demultiplexing unit which demultiplexes the multiplexed signal into the change signals corresponding to respective nozzle rows, and an actuator control unit which, on the basis of each of the demultiplexed change signals, selects one of the drive pulses included in one of the drive signal which corresponds to the demultiplexed change signal, and applies the selected drive pulse to a piezoelectric element included in one of the nozzle rows which corresponds to the drive signal corresponding to the demultiplexed change signal.

3 Claims, 5 Drawing Sheets

LIQUID EJECTION APPARATUS AND CONTROL METHOD FOR LIQUID EJECTION APPARATUS

BACKGROUND

1. Technical Field

The present invention relates to liquid ejection apparatuses, such as an ink jet type recording apparatus, and control methods for a liquid ejection apparatus, and in particular, it relates to a liquid ejection apparatus and a control method for a liquid ejection apparatus which cause liquid to be ejected through a nozzle by, in order to drive a pressure generation means to cause a pressure variation of the liquid which is contained inside a pressure chamber communicated with the nozzle, applying a drive waveform included in a drive signal to the pressure generation means.

2. Related Art

A liquid ejection apparatus is an apparatus which is provided with an ejection head, and ejects (discharges) various kinds of liquid from the ejection head. Well-known examples of this liquid ejection apparatus include an image recording apparatus, such as an ink jet type printer and an ink jet type plotter, and further, nowadays, this liquid ejection apparatus has been applied to various manufacturing apparatuses by exploiting its characteristic that a very small amount of liquid can be landed on a predetermined position with accuracy. For example, the liquid ejection apparatus is applied to a display manufacturing apparatus for manufacturing a color filter for a liquid crystal display or the like, an electrode formation apparatus for forming an electrode for an organic electro-luminescence (EL) display, a face emitting display (FED) or the like, and a chip manufacturing apparatus for manufacturing a biochip (a biochemical chip). Further, a recording head for the image recording apparatus ejects ink in a liquid condition, and a color-material ejection head for the display manufacturing apparatus ejects solution of red (R), green (G) and blue (B) color materials. Further, an electrode-material ejection head for the electrode manufacturing apparatus ejects a liquid electrode material in a liquid condition, and a bio-organic material ejection head for the chip manufacturing apparatus ejects solution of a bio-organic material.

A recording head, which is a kind of the liquid ejection head described above, is provided with a plurality of nozzle rows (nozzle groups) each being configured such that a nozzle for ejecting liquid is arranged in plural rows which are located parallel to one another. Further, this recording head ejects functional liquid through a nozzle by utilizing a pressure variation of the functional liquid inside a pressure chamber, which is caused by a pressure generation means, such as a piezoelectric element, which is driven by a drive waveform applied thereto. In a general liquid ejection head, a voltage (a drive voltage) of the above drive waveform is set to a voltage value which makes an amount (weight or volume) of liquid ejected from each of nozzle rows uniform, and the relevant drive waveform is used in common to the nozzle rows.

JP-A-2007-210234 is an example of related art.

Nevertheless, even in the case where a drive voltage which is set so as to make an amount (weight or volume) of liquid ejected from each of nozzle rows uniform is used, there has sometimes occurred a variation of a flight velocity of liquid ejected through a nozzle among nozzle rows because of a manufacturing variation among pressure generation means, and the like. This variation of the flight velocity also results in a phenomenon in which a landing position of liquid relative to a landing object, such as a recording medium, varies among nozzle rows. Particularly, in these days, there sometimes occurs a case where the liquid ejection apparatus is used in an application which causes liquid to be ejected at a higher drive frequency while causing a liquid ejection head and a landing object to perform a relative movement at a higher speed, and in this case, the variation of the landing position of liquid results in being significant. Moreover, there is a problem that, in a printer in which an ink jet type recording head, which is a kind of liquid ejection head, is mounted, in the case where a configuration in which inks of the same color are ejected through respective nozzles which are included in mutually different nozzle lines is employed, any variation of a landing position of ink between the inks of the same color results in the degradation of an image quality of recorded images or the like.

In an existing configuration, a latch signal LAT and a change signal CH, which are used for control of selection of one of drive pulses included in a drive signal are common to a plurality of nozzle rows, and thus, it has been difficult to adjust ejection timing for each of the nozzle rows. For this reason, unavoidably, it is necessary to suppress the ejection operation speed below a certain speed in view of the above-described variation of a landing position of liquid, and this suppression leads to a decrease of throughput. Meanwhile, there is an alternative configuration which enables a liquid ejection to be performed at timing suitable for a flight velocity of liquid for each of nozzle rows, by providing a drive signal dedicated to each of the nozzle rows, and further providing the latch signal LAT and the change signal CH dedicated to each of the nozzle rows, which are used for control of selection of one of drive pulses included in a drive signal. In order to practice this alternative configuration, however, there has been an obstacle in which the number of signal lines and the complexity of wiring increase, and this leads to the increase of noise generation sources.

SUMMARY

An advantage of some aspects of the invention is to provide a liquid election apparatus and a control method therefor which enable reduction of a variation of a landing position of liquid due to a variation of a flight velocity of liquid among nozzle groups.

A liquid ejection apparatus according to a first aspect of the invention includes a liquid ejection head that includes a plurality of nozzle groups each including at least one row of plural nozzles, and a plurality of pressure generation means each causing a pressure variation of liquid inside a pressure chamber communicated with a corresponding one of the nozzles, and that causes the pressure generation means to eject the liquid through the corresponding one of the nozzles; a first control means that outputs a plurality of drive signals each including a series of at least one drive waveform, each drive waveform being used for driving one of the pressure generation means, and outputs a plurality of selection control signals each being used for control of selecting one of the at least one drive waveform included in one of the drive signals; a second control means that controls the liquid ejection performed by the liquid ejection head on the basis of the drive signals outputted from the first control means and the selection control signals outputted from the first control means. Further, the first control means outputs the plurality of drive signals, which includes the respective series of at least one drive waveforms, the generation timing points of which are different from one another, to the second control means, and outputs a multiplexed control signal obtained by multiplexing the selection control signals, which correspond to the respective drive signals, to the second control means. Further, the second control means includes a control signal demultiplexing means which demultiplexes the multiplexed control signal into the selection control signals corresponding to the respective nozzle groups, and a drive waveform selection means which, on the basis of each of the demultiplexed selection control signals, selects one of the at least one drive waveform included in one of the drive signals which corresponds to the each of the demultiplexed selection control signals, and applies the selected drive waveform to one of the pressure generation means which belongs to one of the nozzle groups which corresponds to the drive signal corresponding to the each of the demultiplexed selection control signals.

In the liquid ejection apparatus according to the first aspect of the invention, the first control means outputs a plurality of drive signals, which includes respective series of at least one drive waveforms, the generation timing points of which are different from one another, to the second control means, and outputs a multiplexed control signal obtained by multiplexing selection control signals, which correspond to the respective drive signals, to the second control means. Further, the second control means includes a control signal demultiplexing means which demultiplexes the multiplexed control signal into the selection control signals corresponding to the respective nozzle groups, and a drive waveform selection means which, on the basis of each of the demultiplexed selection control signals, selects one of the at least one drive waveform included in one of the drive signals which corresponds to the each of the demultiplexed selection control signals, and applies the selected drive waveform to one of the pressure generation means which belongs to one of the nozzle groups which corresponds to the drive signal corresponding to the each of the demultiplexed selection control signals. Accordingly, it is possible to, in accordance with a flight velocity of liquid ejected through a nozzle belonging to each of the nozzle groups, adjust timing of an ejection of liquid to suitable timing for the each of the nozzle groups. Further, this enables reduction of the variation of a landing position of liquid due to the variation of a flight velocity of liquid. Thus, this configuration according to the first aspect of the invention is suitable for an ejection of liquid at a higher frequency. Moreover, the liquid ejection apparatus according to the first aspect of the invention is configured such that a multiplexed signal resulting from multiplexing the selection control signals corresponding to the respective plurality of drive signals at the first control means side is transmitted to the second control means side, and at the second control means side, the multiplexed signal is demultiplexed into the selection control signals, which are used for control of selecting one of the at least one drive waveform. Accordingly, the number of signal lines does not increase, so that the complexity of wiring can be suppressed.

In the liquid ejection apparatus according to the first aspect of the invention, preferably, each of the nozzle groups is sorted into one of ranks in accordance with a flight velocity of liquid ejected from each of nozzles belonging to the each of the nozzle groups, and the first control means outputs the plurality of drive signals each including the at least one drive waveform, the generation timing of which is set so as to be specific to one of the ranks, and outputs the plurality of selection control signals each corresponding to one of the drive signals corresponding to the respective ranks.

According to this configuration, it is possible to suppress the increase of the size of a circuit configuration and the increase of the number of signals by employing a configuration in which the nozzle groups are sorted into some ranks, and the drive signals and the selection control signals are provided for the respective ranks.

Further, a control method according to a second aspect of the invention is a control method for use in a liquid ejection apparatus which includes a liquid ejection head that includes a plurality of nozzle groups each including at least one row of plural nozzles, and a plurality of pressure generation means each causing a pressure variation of liquid inside a pressure chamber communicated with a corresponding one of the nozzles, and that causes the pressure generation means to eject the liquid through the corresponding one of the nozzles, a first control means that outputs a plurality of drive signals each including a series of at least one drive waveform, each drive waveform being used for driving one of the pressure generation means, and outputs a plurality of selection control signals each being used for control of selecting one of the at least one drive waveform included in one of the drive signals, a second control means that controls the liquid ejection performed by the liquid ejection head on the basis of the drive signals outputted from the first control means and the selection control signals outputted from the first control means. Further, this control method includes causing the first control means to output the plurality of drive signals, which includes the respective series of at least one drive waveforms, the generation timing points of which are different from one another, to the second control means, and output a multiplexed control signal obtained by multiplexing the selection control signals, which correspond to the respective drive signals, to the second control means, and causing the second control means to demultiplex the multiplexed control signal into the selection control signals corresponding to the respective nozzle groups, and on the basis of each of the demultiplexed selection control signals, select one of the at least one drive waveform included in one of the drive signals which corresponds to the each of the demultiplexed selection control signals, and apply the selected drive waveform to one of the pressure generation means which belongs to one of the nozzle groups which corresponds to the drive signal corresponding to the each of the demultiplexed selection control signals.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment to practice the invention will be described with reference to the accompanying drawings. It is to be noted here that, although various restrictions are imposed on an embodiment described below which is positioned as a preferable specific example of the invention, the scope of the invention is not restricted to such an embodiment, provided that, in description below, there is not any particular notice for notifying a restriction on the invention. Further, hereinafter, description will be made by exemplifying an ink jet type recording apparatus (hereinafter, referred to as just a printer) as a liquid ejection apparatus according to an aspect of the invention.

Figure 1:
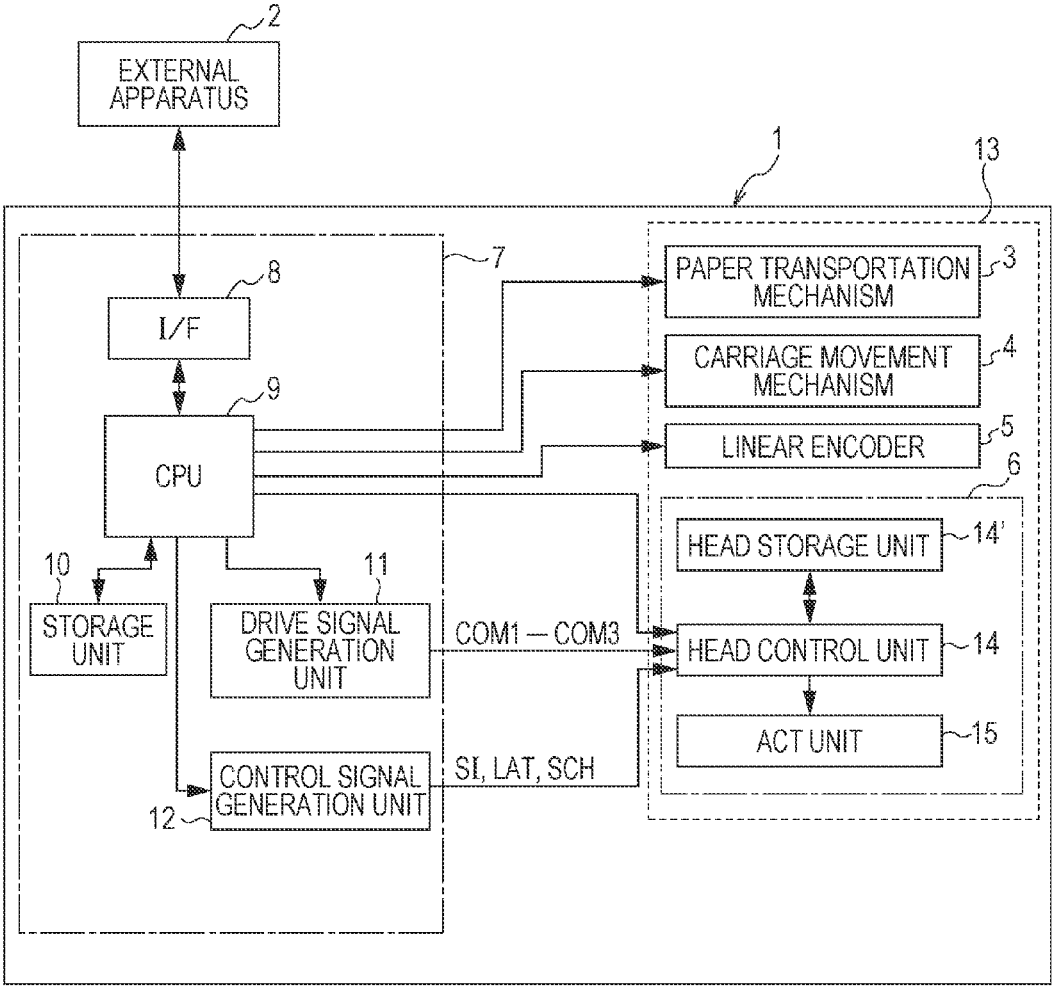
FIG. 1 is a block diagram illustrating an electric configuration of a printer according to an embodiment of the invention.
Figure 2:
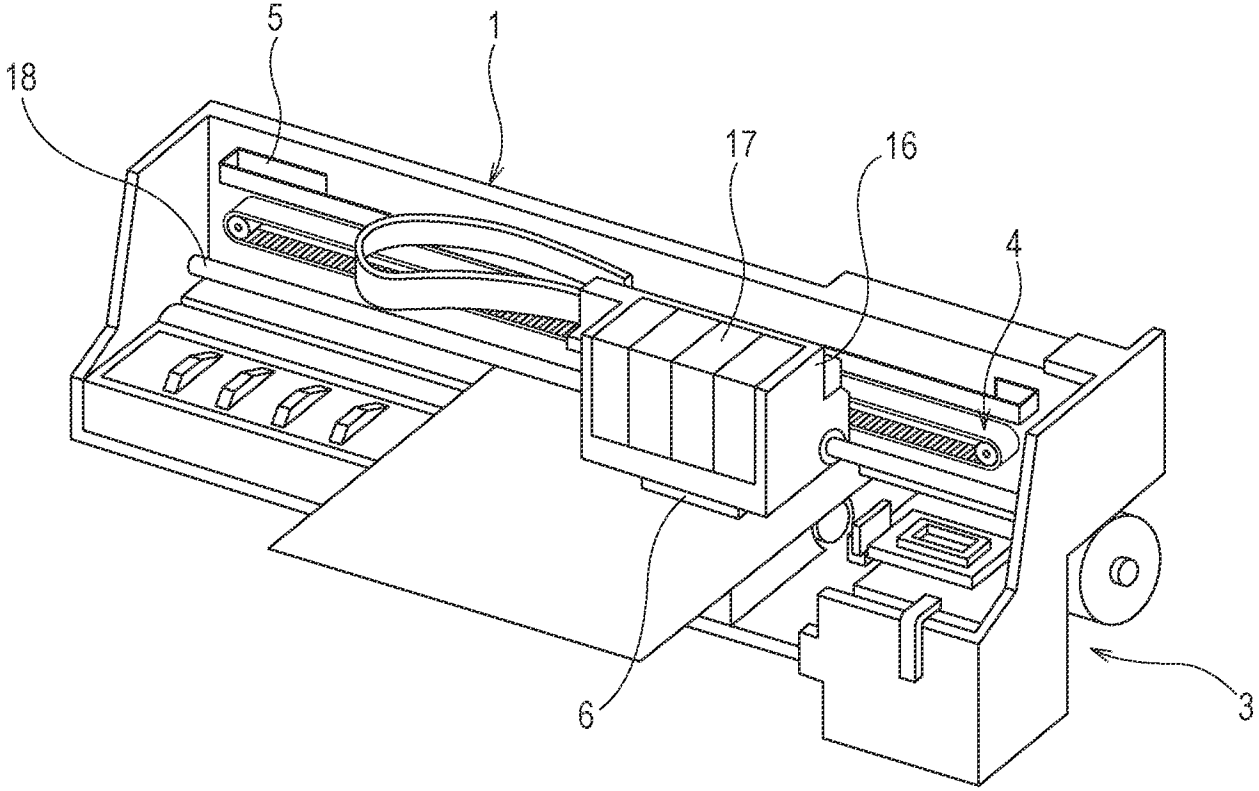
FIG. 2 is a perspective view illustrating an internal configuration of a printer according to an embodiment of the invention.

FIG. 1 is a block diagram illustrating an electric configuration of a printer 1, and FIG. 2 is a perspective view of an internal configuration of the printer 1. An external apparatus 2 is an electronics device, such as a computer or a digital camera, which deals with images. This external apparatus 2 is communicably connected to the printer 1, and in order to allow the printer 1 to perform printing of images or texts on a recording medium, such as recording paper, the external apparatus 2 transmits print data corresponding to the images or the like to the printer 1.

The printer 1 according to this embodiment includes a paper transportation mechanism 3, a carriage movement mechanism 4, a linear encoder 5, a recording head 6 and a printer controller 7. The recording head 6 is fixed to the bottom face of a carriage 16 on which ink carriages 17 are mounted. Further, the carriage 16 is configured so as to be reciprocatably moved along a guide rod 18 in conjunction with operation of the carriage movement mechanism 4. That is, the printer 1 performs printing of images or the like on a recording medium (recording paper) by causing the paper transportation mechanism 3 to sequentially transport the recording medium, and concurrently causing the recording head 6 to eject ink through nozzles 34 thereof (refer to FIG. 4) so as to cause the ink to be landed on the recording medium while causing the recording head 6 to make a relative movement relative to the recording medium.

The printer controller 7 is a kind of the first control means according to the first and second aspects of the invention, and is a control unit for controlling individual units of the printer. The printer controller 7 includes an interface (I/F) unit 8, a CPU 9, a storage unit 10, a drive signal generation unit 11 and a control signal generation unit 12. The interface unit 37 performs data exchange of print commands and print data from the external apparatus 2 to the printer 1, as well as printer state data from the printer 1 to the external apparatus 2 at the time of outputting of state information related to the printer 1 to the external apparatus 2 side. The CPU 9 is an arithmetic processing device for controlling the whole of the printer 1. The storage unit 10 is a component which stores therein programs executed by the CPU 9 and data used by various control processes, and includes ROM, RAM and NVRAM (nonvolatile memory element). The CPU 9 performs control of individual units in accordance with the programs stored in the storage unit 10.

Figure 3:
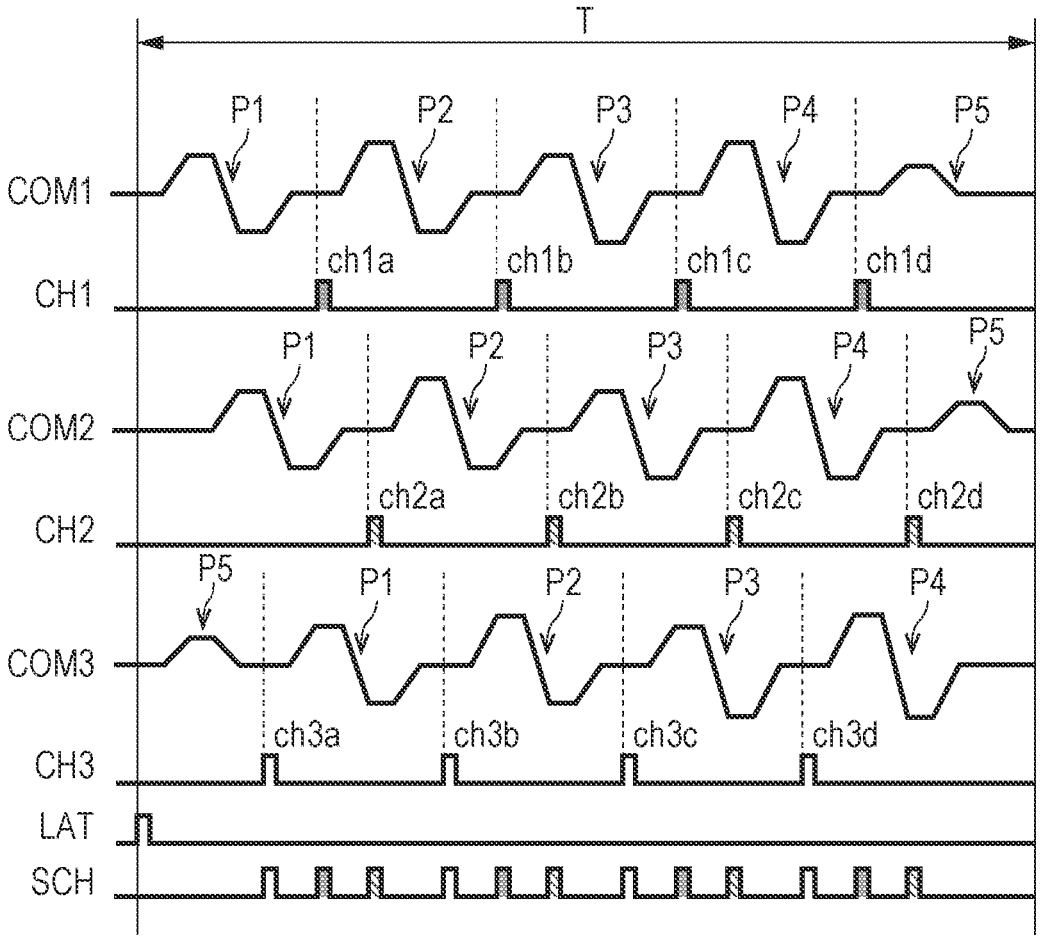
FIG. 3 is a waveform diagram illustrating a configuration of drive signals according to an embodiment of the invention.

The drive signal generation unit 11 generates analog voltage signals on the basis of waveform data in relation to waveforms of drive signals. Further, the drive signal generation unit 11 generates a plurality of drive signals COM by amplifying the voltage signals described above. The drive signal generation unit 11 according to this embodiment is configured such that the plurality of the drive signals COM includes respective series of drive pulses, the timing points of which are different from one another, as shown in FIG. 3. Specifically, the drive signal generation unit 11 generates three kinds of drive signals (a first drive signal COM 1, a second drive signal COM 2 and a third drive signal COM 3).

FIG. 3 is a waveform diagram illustrating an example of a configuration of drive signals according to this embodiment.

As shown in FIG. 3, each of the drive signals COM 1 to 3 is repeatedly generated at intervals of a cycle T (hereinafter, referred to as a unit cycle T) which is defined by a latch signal LAT described below. The unit cycle T of this embodiment is partitioned into totally five pulse periods by the latch signal LAT and change signals CH (change pulses ch). The drive signals COM 1 to 3 each include totally five drive pulses (corresponding to the drive waveforms according to the first and second aspects of the invention) within the unit cycle T, the five drive pulses being a first ejection drive pulse P1, a second ejection pulse P2, a third ejection pulse P3, a fourth ejection drive pulse P4 and a slight vibration drive pulse P5. Further, one drive pulse is generated per one pulse period. The ejection drive pulse and the slight vibration drive pulse each have a waveform known to those skilled in the art, and thus, detailed description thereof is omitted here. In addition, the type and the number of the drive pulses included in each of the drive signals are not restricted to those exemplified above, but, are the same with those of any other one of the drive signals. Further, generation order of the ejection drive pulses P1 to P4, except for the slight vibration drive pulse P5, for each of the drive signals is the same as that for any other one of the drive signals.

With respect to corresponding drive pulses (drive pulses of the same kind) included in the respective drive signals, generation timing points thereof within the unit cycle T are slightly different from one another. In this embodiment, when a generation timing point of a series of drive pulses included in the second drive signal COM 2 (hereinafter, arbitrarily, also referred to as just a reference series of pulses) is defined as a reference timing point, with respect to generation timing points of two series of drive pulses, which are include in the respective first and third drive signals COM 1 and COM 3, one of the generation timing points of the two series of drive pulses is ahead of the reference timing point, and the other one of the generation timing points of the two series of drive pulses is behind the reference timing point. Specifically, the generation timing point of the series of drive pulses included in the first drive signal COM 1 is set so as to be slightly earlier than the reference timing point of the reference series of pulses. Further, the generation timing point of the series of drive pulses included in the third drive signal COM 3 is set so as to be slightly later than the reference timing point of the reference series of pulses.

The amount of a time difference with the reference timing point is determined in accordance with a flight velocity Vm of ink ejected from the nozzle 34. That is, in such a structure of the recording head 6 of this embodiment, in which a plurality of nozzle rows 35 is included (the nozzle rows 35 being a kind of the nozzle groups, which will be described below), the flight velocity of ink ejected through the nozzle largely varies for each of the nozzle rows because of a manufacturing variation among the piezoelectric elements, an assembly variation (particularly, a position misalignment between the piezoelectric element and the pressure chamber), a size-and-shape variation among ink flowing paths including pressure chambers, and/or the like. Thus, the printer 1 according to this embodiment is configured so as to reduce the variation of a landing-position misalignment of ink due to the variation of the flight velocity of ink, by sorting the individual nozzle rows 35 into some ranks in accordance with the degrees of the flight velocities of inks with respect to the respective nozzle rows 35, and performing an ink ejection (a printing operation) for each of the nozzle rows 35 while selecting one of the drive signals which corresponds to one of the rank, to which the each of the nozzle row 35 belongs. In addition, the above-described amount of a time difference with the reference timing point is determined (corrected) on the basis of a correction amount t corresponding to each of the ranks.

In addition, for each of the first drive signal COM 1 and the second drive signal COM 2, the slight vibration drive pulse P5 is generated during a last pulse period of the unit cycle T; while, for the third drive signal COM 3, the slight vibration drive pulse P5 is generated during a first pulse period of the unit cycle T because of the influence of the generation timing points of the ejection drive pulses. As described above, since the generation timing points of the series of drive pulses included in the respective drive signals COM are different from one another, the generation timing points of the series of the change signals CH, which are used for control of selection of the corresponding drive pulses, are also different from one another. Thus, the control signal generation unit 12 according to this embodiment outputs totally three change signals of a first change signal CH 1, a second change signal CH 2 and a third change signal CH 3 which correspond to the respective drive signals COM 1 to COM 3, as described below.

The control signal generation unit 12 outputs head control signals, which are used for control of the recording head 6, to the head control unit 14 side. The head control signals includes, for example, a transfer clock CLK, pixel data SI, the latch signal LAT and the change signals CH. The latch signal LAT and the change signals CH are selection control signals used for control of a selective application of one of the drive pulses included in the respective drive signals COM 1 to 3 to one of the piezoelectric elements 22. The control signal generation unit 12 generates the latch signal LAT and the change signals CH on the basis of a timing pulse PTS which is outputted from the linear encoder 5 in response to the movement of the recording head 6 in a main-scanning direction. The latch signal LAT is a signal which defines a starting timing point of a cycle of a recording operation for one pixel, and which defines the repeated unit cycle T of each of the drive signals COM, as described above. Further, this latch signal LAT is also a signal which defines a timing point of applying a drive pulse, which is generated first in each of the drive signals COM, to one of the piezoelectric elements.

Further, the change signals CH are signals each including a series of change pulses which are sequentially generated at intervals of a predetermined period of time subsequent to the latch signal LAT, and defining a timing point of applying a corresponding one of the drive pulses included in one of the drive signals COM to one of the piezoelectric elements 23. The latch signal LAT is a selection control signal common to the drive signals COM 1 to 3; while the change signals CH are signals which are generated so as to individually correspond to the respective drive signals COM 1 to 3. That is, the control signal generation unit 12 outputs totally three change signals of a first change signal CH 1, a second change signal CH 2 and a third change signal CH 3 which correspond to the respective drive signals COM 1 to COM 3. Thus, it can be said that the latch signal LAT is a common selection signal and the change signals CH are individual selection signals. The change signal corresponding to one unit cycle T includes totally four change pulses of a cha, chb, chc and chd. The generation timing of a series of the change pulses cha to chd subsequent to the latch signal LAT in each of the change signals CH 1 to CH 3 is different from that in any other one of the change signals CH 1 to CH 3. That is, the generation timing of the series of the change pulses cha to chd included in a certain one of the change signals CH is set in accordance with that of the series of drive pulses included in one of the drive signals COM, which corresponds to the certain change signal. In addition, time differences with the second change signal CH 2 with respect to the first change signal CH 1 and the third change signal CH 3 are determined (corrected) on the basis of the correction amounts t corresponding to the ranks, respectively.

Here, parameters in relation to the landing position of ink on a recording medium, such as printing paper, include not only the ink flight velocity Vm but also a movement velocity Vcr of the carriage 16 and a distance PG from the nozzles 34 of the recording head 6 to the recording medium. In a so-called serial printer just like the printer 1 of this embodiment which records images or the like on a recording medium while causing the recording head 6 to perform a relative movement relative to the recording medium, first, a predicted landing position L on a recording medium is calculated for each of the nozzle rows on the basis the above PG as well as the above Vm and Vcr of the each of the nozzle rows 35. In addition, the predicted landing position L is, for example, a position which is located in a scanning direction of a cartridge, and which, after a liquid has been ejected through a nozzle of a recording head towards a recording medium, is predicted from a distance from the center of the nozzle to the center of the liquid which has landed on the recording medium. Next, for each of the nozzle rows 35, a misalignment amount ΔL is calculated, this misalignment amount ΔL being a misalignment amount of the predicted landing position L with respect to each of nozzle rows 35 other than a particular nozzle row 35 (hereinafter, referred to as a reference nozzle row) which has a central value of the values of the ink flight velocities Vm of the respective nozzle rows 35, or a value closest to a target value in a design specification. Further, the nozzle rows 35 are sorted into some ranks on the basis of the misalignment amounts ΔL of the respective nozzle rows 35. In this embodiment, the nozzle rows 35 are sorted into totally three ranks including a reference rank corresponding to the reference nozzle row 35. A correction amount (a period of time to be corrected) of each of ranks other than the reference rank is calculated by using the following formula (1).

$$t=\Delta L/Vcr \tag{1}$$

Correction amounts t having been calculated by using this formula are incorporated in after-described generation timing points of the change signals CH, as well as after-described generation timing points of the series of drive pulses included in the first and third drive signals COM 1 and COM 3, respectively.

In addition, in a printer which is configured to, just like a so-called line printer, employ a method of performing recording operation while transporting a recording medium relative to a recording head whose position is fixed, similarly, the predicted landing position and the correction amount can be calculated on the basis of the above PG, and the above Vm of each of the nozzle rows 35, as well as a transportation velocity Vp of the recording medium which is transported in conjunction with operation of a paper transportation mechanism.

Meanwhile, in a configuration, in which the change signals CH 1 to CH 3 corresponding to the respective drive signals COM 1 to COM 3 are transmitted to the recording head 6 side by using non-integrated individual signal lines, there is a problem that the number of signal lines increases by the number of the non-integrated signal lines. Thus, the control signal generation unit 12 is configured so as to output a multiplexed change signal SCH (corresponding to a multiplexed control signal according to the first and second aspects of the invention) resulting from multiplexing the first change signal CH 1, the second change signal CH 2 and the third change signal CH 3 (refer to a lowest line in FIG. 3). In addition, it is also possible to employ a configuration which allows the latch signal LAT to be multiplexed together with the individual change signals CH.

The pixel data SI is data related to pixels printed on a recording medium, and is a kind of ejection control information. Here, this pixel is a constituent unit of images or the like recorded on a recording medium which is an object targeted for landing of ink. Further, a pixel area means a virtual area on a recording medium, within which the pixels are to be formed. Further, the pixel data SI of print data includes pieces of information each indicating the presence or absence of a corresponding dot formed on a recording medium (or the necessity or unnecessity of a corresponding ink ejection), and pieces of data (gray-scale values) each indicating a size of a corresponding dot (or a corresponding amount of ink to be ejected). In this embodiment, each piece of pixel data SI is composed of two bits representing a gray-scale value. That is, with respect to this pixel data SI, there are four kinds of data: a piece of data [00] corresponding to the absence of a dot (a slight vibration); a piece of data [01] corresponding to a small size dot; a piece of data [10] corresponding to a middle size dot; and a piece of data [11] corresponding to a large size dot. Thus, in this printer according to this embodiment, it is possible to form a dot by using any one of these four gray-scale values. Further, a width of the pixel area corresponds to a distance up to which the recoding head 6 moves during the unit cycle T.

Next, a print engine 13 will be described. As shown in FIG. 1, this print engine 13 includes the recording head 6, the carriage movement mechanism 4, the paper transportation mechanism 3, the linear encoder 5 and the like. The carriage movement mechanism 4 includes the carriage 16 to which the recording head 6, which is a kind of liquid ejection head, is attached, a drive motor (for example, a DC motor) for driving the carriage 16 via a timing belt or the like (the drive motor being not illustrated), and the like, and moves the recording head 6, which is mounted on the carriage 16, in a main-scanning direction. The paper transportation mechanism 3 includes a paper transportation motor, a paper transportation roller and the like, and performs a sub-scanning operation by sequentially sending out recording paper (a kind of recording medium, and a kind of object targeted for landing of ink) onto a platen. Further, the linear encoder 5 outputs an encoder pulse corresponding to a scanning position of the recording head 6 mounted on the carriage 16 to the printer controller 7 as a piece of position information in a main-scanning direction. The printer controller 7 can recognize the scanning position (a current position) of the recording head 6 on the basis of the encoder pulse having been received from the linear encoder 5 side.

Figure 4:
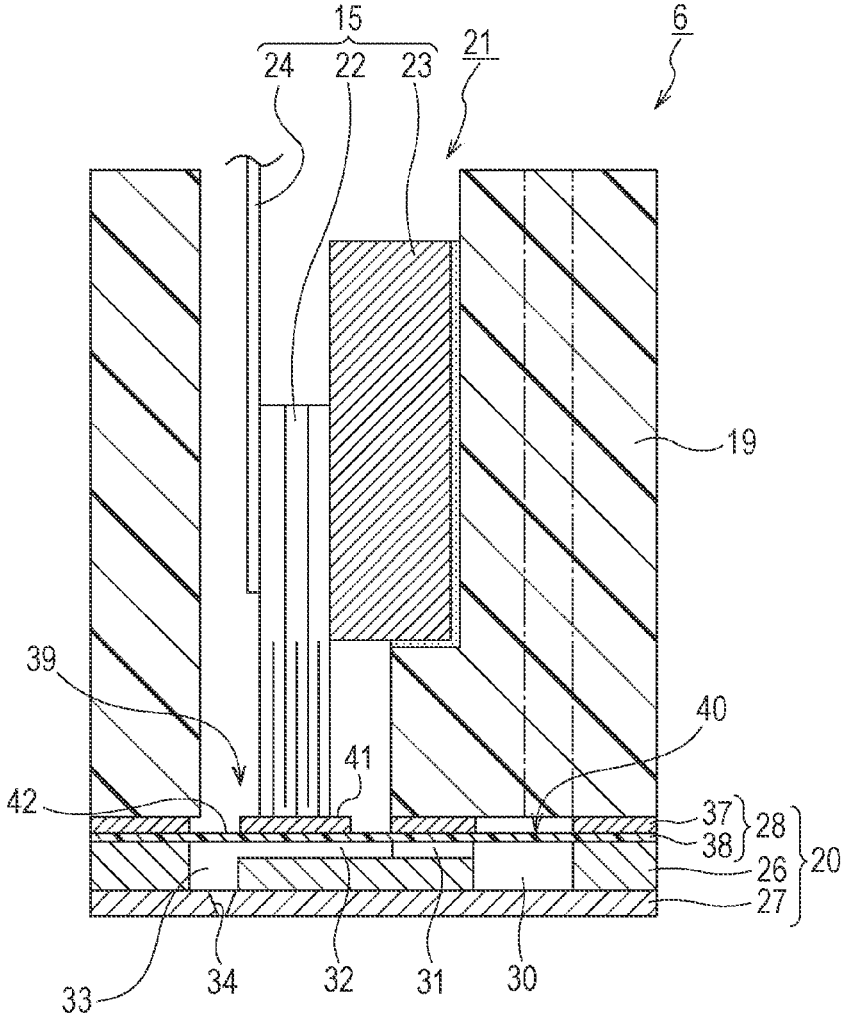
FIG. 4 is a cross-sectional view illustrating a configuration of a recording head according to an embodiment of the invention.

FIG. 4 is a cross-sectional view of substantial part of the recording head 6, and is used for describing a configuration of the recording head 6. This recording head 6 includes a case 19, a vibrator unit 15 (a pressure generation means in a broad sense) contained in the case 19, a flowing path unit 20 jointed to the bottom face (the edge face) of the case 19, and the like. The above case 19 is manufactured by using, for example, an epoxy type resin, and inside the case 19, there is formed a containing space 21 in which the vibrator unit 15 is contained. The vibrator unit 15 includes the piezoelectric element 22 functioning as a pressure generation means in a narrow sense, a fixed plate 23 to which the piezoelectric element 22 is jointed, and a flexible cable 24 for supplying the drive signals (the drive pulses) to the piezoelectric element 22. The piezoelectric element 22 is a laminated type piezoelectric element which is manufactured by carving a piezoelectric plate, in which a piezoelectric layer and an electrode layer are alternately laminated, in a comb-teeth shape. Further, the piezoelectric element 22 is a piezoelectric element which is in a vertical vibration mode, and is expandable and contractible in a direction orthogonal to a lamination direction (an electric-field direction), that is, is of electric-field lateral effect type.

The flowing path unit 20 is configured such that a nozzle plate 27 thereof is jointed to one of the faces of a flowing path forming substrate 26 and a vibration plate 28 thereof is jointed to the other one of the faces of the flowing path forming substrate 26. This flowing path unit is provided with a reservoir 30 (a common liquid chamber), an ink feed opening 31, a pressure chamber 32, a nozzle communicating opening 33 and the nozzle 34. Further, a series of ink flowing paths from the ink feed opening 31 up to the nozzle 34 via the pressure chamber 32 and the nozzle communicating opening 33 are formed for each of the nozzles 34.

Figure 5:
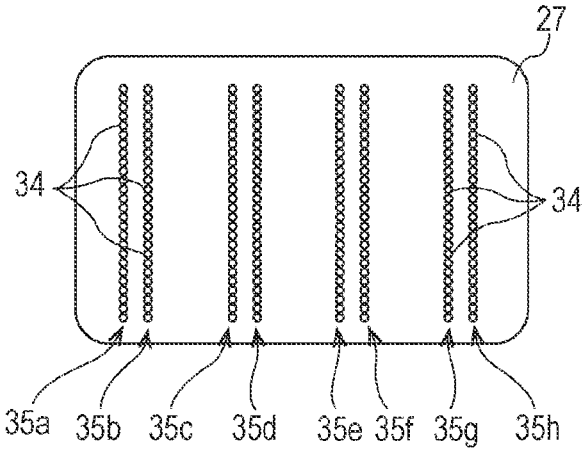
FIG. 5 is a plan view illustrating a configuration of a nozzle plate according to an embodiment of the invention.

FIG. 5 is a plan view illustrating a configuration of the nozzle plate 27. The above nozzle plate 27 is a thin plate of a metallic material, such as a stainless steel, in which holes for the respective plurality of nozzles 34 are drilled in rows at intervals of a pitch adapted to a dot formation density (for example, 360 dpi). This nozzle plate 27 is provided with the plurality of nozzle rows 35 (nozzle groups) in each of which the nozzles 34 align, and one of the nozzle rows 35 is composed of the nozzles 34 whose number is, for example, 360. The nozzle plate 27 of this embodiment includes totally eight nozzle rows 35*a* to 35*h* formed thereon, which are arranged in a head main-scanning direction. In the recording head 6 of this embodiment, totally eight actuator units 15 are installed inside the respective individual containing space portions 21 such that the actuator units 15 are correlated with the respective nozzle rows 35A to 35H.

In this embodiment, since the actuators 15 are individually installed for the respective nozzle rows 35, the flight velocities of ejected inks among the nozzle rows 35 are likely to vary because of a manufacturing variation among the actuator units 15. For this reason, with respect to the recording head 6 of this embodiment, the nozzle rows 35 are sorted into totally three ranks (groups) A to C in accordance with the flight velocities of inks ejected through the nozzles 34 included in the respective nozzle rows 35. That is, nozzle rows 35 (for example, nozzle rows 35*a*, 35*c* and 35*e*), for each of which the flight velocity of ink ejected through the nozzle 34 falls within any one of predetermined ranges immediately anterior and posterior to a target flight velocity in a design specification of the printer 1, (the predetermined ranges being correctively referred to as a reference range), are determined to belong to a rank B (a reference rank); nozzle rows 35 (for example, nozzle rows 35*b*, 35*d* and 35*h*), for each of which the flight velocity is smaller than those falling within the reference range, are determined to belong to a rank A; and nozzle rows 35 (for example, nozzle rows 35*f* and 35*g*), for each of which the flight velocity is larger than those falling within the reference range, are determined to belong to a rank C. Further, pieces of correction information t (t1 and t3) corresponding to the respective ranks other than the reference rank are stored in a head storage unit 14' of the recording head 6 so as to be correlated with the corresponding nozzle rows 35. Further, in this embodiment, with respect to the nozzle rows 35 belonging to the rank A, ink ejections (recording operations) are performed by using the first drive signal COM 1 in which the correction information t1 is incorporated; with respect to the nozzle rows 35 belonging to the rank B, ink ejections are performed by using the second drive signal COM 2; and with respect to the nozzle rows 35 belonging to the rank C, ink ejections (recording operations) are performed by using the third drive signal COM 3 in which the correction information t3 is incorporated. It is to be noted here that, naturally, the number of the ranks, the number of the drive signals corresponding thereto, and the number of the change signals CH are not limited to the respective exemplified numbers.

The above vibration plate 28 has a double structure of a support plate 37 and an elastic film 38 laminated on the surface of the support plate 37. In this embodiment, the vibration plate 28 is manufactured by using a composite plate material which is obtained by employing a stainless steel plate, which is a kind of metallic plate, as the support plate 37, and laminating a resin film as the elastic film 38 on the surface of the support plate 37. Further, the vibration plate 28 is provided with a diaphragm unit 39 which causes the inner volume of the pressure chamber 32 to vary. Further, the vibration plate 28 is provided with a compliance unit 40 which seals part of the reservoir 30.

The above diaphragm unit 39 is manufactured by partially removing the support plate 37 by means of an etching process or the like. That is, this diaphragm unit 39 is composed of an island portion 41, to which the edge face of the piezoelectric element 22 is jointed, and an elastic portion 42 surrounding this island portion 41. The above compliance unit 40 is manufactured by removing an area of the support plate 37, which is opposite to an opening face of the reservoir 30, by means of an etching process or the like, just like the case of the diaphragm unit 39. The above compliance unit 40 functions as a damper for absorbing the variation of pressure of liquid accumulated in the reservoir 30.

Further, since an edge face of the piezoelectric element 22 is jointed to the above island portion 41, it is made possible to allow the inner volume of the pressure chamber 32 to vary by expanding and contracting a free edge portion of the piezoelectric element 22. A pressure variation occurs in ink inside the pressure chamber 32 in conjunction with the volume variation. Further, the recording head 6 is configured to eject ink through the nozzle 34 by utilizing this pressure variation.

Next, an electric configuration of this recording head 6 will be described.

Figure 6:
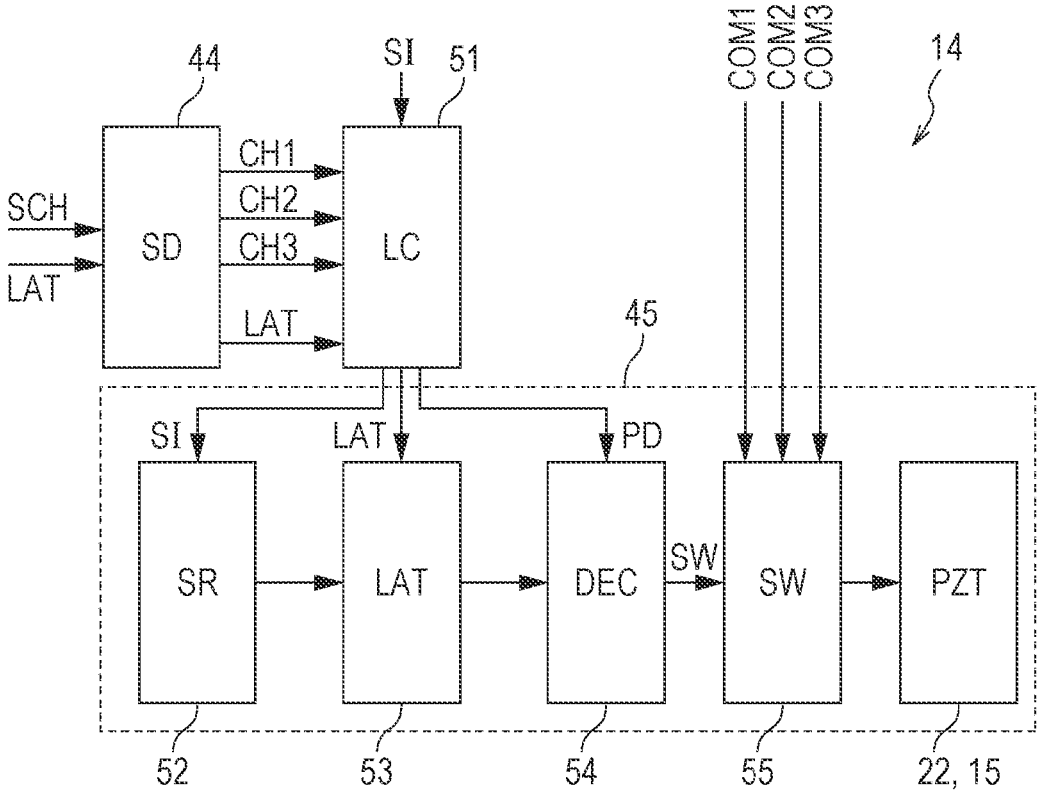
FIG. 6 is a block diagram illustrating an electric configuration of a head control unit according to an embodiment of the invention.

FIG. 6 is a block diagram illustrating a configuration of the head control unit 14. The head control unit 14 of this embodiment includes a control signal demultiplexing unit (SD) 44, a control logic (LC) circuit 51 and actuator control units 45. In addition, the control signal demultiplexing unit 44 and the control logic circuit 51 are circuits common to the actuator units 15 for the respective nozzle rows 35, and the actuator control unit 45 is a circuit provided for each of the piezoelectric elements 22 included in each of the actuator units 15 for the respective nozzle rows 35. FIG. 6 illustrates a configuration of the actuator control unit 45 corresponding to one of the piezoelectric elements 22, and a configuration of the actuator control units 45 corresponding to any other one of the piezoelectric elements 22 is the same as that illustrated in FIG. 6.

Figure 7:
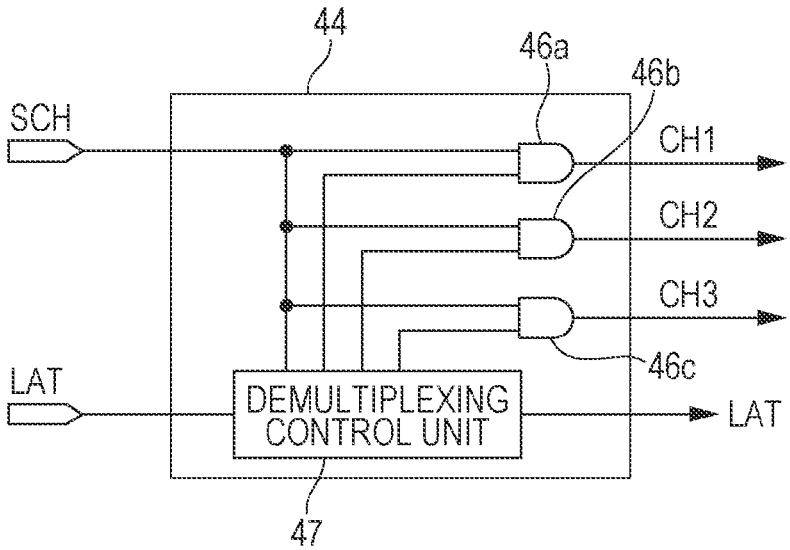
FIG. 7 is a block diagram illustrating an electric configuration of a control signal demultiplexing unit according to an embodiment of the invention.

FIG. 7 is a block diagram illustrating a configuration of the control signal demultiplexing unit 44. The LAT signal and the SCH signal transmitted from the printer controller 7 are inputted to the control signal demultiplexing unit 44. Further, the control signal demultiplexing unit 44 is configured to output the LAT signal to the control logic circuit 51, and further output the change signals CH1 to CH3 resulting from demultiplexing the multiplexed change signal SCH to the control logic circuit 51. The control signal demultiplexing unit 44 of this embodiment includes a demultiplexing control unit 47 and three AND circuits 46*a* to 46*c*. The SCH signal and the LAT signal are inputted to the demultiplexing control unit 47. Further, the SCH signal is also inputted to each of the AND circuits 46*a* to 46*c*.

Further, the selection control unit 47 is configured to, starting at a timing point of the input of the LAT signal, for each of the AND circuits 46*a* to 46*c*, at timing points when the individual change pulses (cha to chd), which are multiplexed in the SCH signal and correspond to one of the CH signals CH 1 to CH 3, are sequentially inputted to the relevant AND circuit, perform switching of the level of an output signal to the relevant AND circuit from Low to Hi in order in accordance with the order of the input of the individual change pulses. This configuration allows the first change signal CH 1, the second change signal CH 2 and the third change signal CH 3 to be sequentially outputted from the AND circuit 46*a*, the AND circuit 46*b* and the AND circuit 46*c*, respectively. In this manner, the control signal demultiplexing unit 44 demultiplexes the multiplexed change signal SCH from the printer controller 7 side into the individual change signals CH 1 to CH 3.

The latch signal LAT and the change signals CH outputted from the control signal demultiplexing circuit 44, as well as the pixel data SI from the printer controller 7 side, are inputted to the control logic circuit 51. Further, the control logic circuit 51 is configured to, for each of the piezoelectric elements 22, generate a piece of pulse selection data PD, which indicates which one of the drive pulses of one of the drive signals is to be applied to the relevant piezoelectric element 22, from the pixel data SI on the basis of the above input signals. For example, when the content of the two bits of the input pixel data SI is [0, 0] indicating non-recording (a slight vibration) in which any dots are not formed, the control logic circuit 51 generates a piece of pulse selection data PD [0, 0, 0, 0, 1] indicating a selection of the slight vibration drive pulse P5 of the five drive pulses P1 to P5 included in one of the drive signals. Similarly, when the content of the two bits of the input pixel data SI is [0, 1] indicating a minimum size dot, the control logic circuit 51 generates a piece of pulse selection data PD [0, 0, 1, 0, 0] indicating a selection of the ejection drive pulse P3 of the five drive pulses P1 to P5 included in one of the drive signals.

As described above, it is determined, in advance, in accordance with a recording gray-scale level specified by a piece of the pixel data SI which one of the drive pulses of one of the drive signals is to be selected, and thus, a piece of the pulse selection data PD corresponding to the piece of pixel data SI can be generated by the control logic circuit 51. The piece of the pulse selection data PD is outputted to a decoder 54 of the actuator control unit 45 at a timing point of the input of one of the latch signal LAT and the change pulses of one of the change signals CH. Here, the output control of the actuator control unit 45 corresponding to a group of nozzle rows belonging to the rank A is performed on the basis of the timing of the first change signal CH 1, in which the correction information t1 is incorporated. Similarly, the output control of the actuator control unit 45 corresponding to a group of nozzle rows belonging to the rank B is performed on the basis of the timing of the second change signal CH 2, and the output control of the actuator control unit 45 corresponding to a group of nozzle rows belonging to the rank C is performed on the basis of the timing of the third change signal CH 3, in which the correction information t3 is incorporated.

The actuator control unit 45 includes a shift register circuit (SR) 52, a latch circuit (LAT) 53, the decoder (DEC) 54, a switch (SW) 55 and the piezoelectric element (PZT) 22. The pixel data SI is inputted to the shift register circuit 52. Further, the latch circuit 53 is connected, as a subsequent stage, to the shift register circuit 52. Further, the pixel data SI is sequentially transmitted to the shift register circuits 52 corresponding to the respective nozzles 34, and at the time when the pixel data SI has been set into all the shift register circuits 52 corresponding to the respective nozzles 34, and further, the latch signal from the control logic circuit 51 has been inputted to the latch circuits 53, the latch circuits 53 perform latching of the pixel data SI stored in the corresponding shift register circuits 52.

The decoder 54 outputs a switch control signal sw for controlling the switch 55 on the basis of the pixel data SI having been latched in the latch circuit 53 as well as the piece of pulse selection data PD outputted from the control logic circuit 51. In this operation, when having acquired the piece of pulse selection data PD, which is outputted from the control logic circuit 51, on the basis of the pixel data SI, the decoder 54 outputs the switch control signal sw. The switch control signal sw outputted from the decoder 54 is inputted to the switch 55. This switch 55 is a switch which turns on/off in accordance the switch control signal sw, and applies one of the drive signals to the piezoelectric element 22 during an on-period. The drive signals COM 1 to COM 3 from the printer controller 7 side are inputted to the switch 55. Further, the piezoelectric element 22 is connected to the output side of the switch 55. When the switch control signal sw is in a state of data [1], the switch 55 becomes in an on-state, so that one of the drive signals is applied to the piezoelectric element 22. In contrast, when the switch control signal sw is in a state of data [0], the switch 55 becomes in an off-state, so that any of the drive signals is not applied to the piezoelectric element 22. Further, the switch 55 of the group of nozzle rows belonging to the rank A performs switching of the application of a drive pulse of the first drive signal COM 1 to the piezoelectric element 22. Similarly, the switch 55 of the group of nozzle rows belonging to the rank B performs switching of the application of a drive pulse of the second drive signal COM 2 to the piezoelectric element 22, and the switch 55 of the group of nozzle rows belonging to the rank C performs switching of the application of a drive pulse of the third drive signal COM 3 to the piezoelectric element 22.

Such a switching control makes it possible to apply a drive pulse included in one of the drive signals, which corresponds to a certain one of the ranks, to the piezoelectric element 20 corresponding to each of nozzle rows 35 which are sorted to the relevant rank. This configuration makes it possible to perform an ink ejection at timing more suitable for the flight velocity of ink ejected through the nozzle 34, which depends on which one of the nozzle rows 35 the nozzle 34 belongs to, than in the case of previously known configurations, thereby enabling reduction of the misalignment of a landing position of ink due to the variation of the flight velocity. That is, with respect to nozzle rows 35 belonging to the rank B in which the flight velocities of ejected inks fall within a reference range, through ink ejection control using the second drive signal COM 2, the inks are landed on respective target positions of a recording medium. Further, with respect to nozzle rows 35 belonging to the rank A in which the flight velocities of ejected inks are smaller than those of the reference range, in the case where the invention is not applied, the inks are landed on respective positions which are misaligned at a more forward side than the respective target landing positions in the movement direction of the recording head 6, but, through ink ejection control using the first drive signal COM 1, ink ejections can be performed at earlier timing points. This configuration enables landing positions on the recording medium to be closer to respective target positions than in the case of previously known configurations. Similarly, with respect to nozzle rows 35 belonging to the rank C in which the flight velocities of ejected inks are larger than those of the reference range, in the case where the invention is not applied, the inks are landed on respective positions which are misaligned at a more backward side than the respective target landing positions in the movement direction of the recording head 6, but, through ink ejection control using the third drive signal COM 3, ink ejections can be performed at later timing points. This configuration enables landing positions on the recording medium to be closer to respective target positions than in the case of previously known configurations.

As described above, in the printer 1 according to this embodiment, it is possible to adjust the landing positions of inks at a pitch smaller than a pixel width equivalent to the unit cycle T. Accordingly, in a configuration in which an ink ejection is performed at a higher frequency, it is also possible to reduce the misalignment of a landing position. Further, it is possible to suppress the increase of the number of signal lines as well as the complex state of wiring by employing the above-described configuration. The above-described configuration is realized such that the multiplexed change signal SCH, which is obtained by multiplexing the individual change signals CH, which are related to control of selection of a drive pulse included in one of the plurality of drive signals, at the printer controller 7 side, is transmitted to the recording head 6 side, and at the recording head 6 side, the multiplexed change signal SCH is demultiplexed into the individual change signals CH used for the selection control of a drive pulse. Moreover, it is possible to suppress the increase of the size of a circuit configuration and the increase of the number of signals by employing a configuration in which the nozzle groups 35 are sorted into some ranks, and the drive signals and the selection control signals are provided for the respective ranks.

It is to be noted here that the invention is not limited to the aforementioned embodiment, but various modifications can be made on the basis of the terms of the appended claims.

The number of the drive signals and the configuration of waveforms included in the drive signals are not limited to those exemplified in the aforementioned embodiment, and the invention can be applied to liquid ejection heads which have various configurations with respect to the drive signal and the drive waveform.

Further, with respect to the nozzle rows 35, in the aforementioned embodiment, the recording head 6 having eight nozzle rows has been exemplified, but the invention is not limited to this configuration, and can be applied to any liquid ejection head which has at least two nozzle rows.

Further, the invention can be applied not only a printer but also any liquid ejection apparatus capable of performing liquid ejection control using a method of driving a pressure generation means by applying a drive waveform thereto, such as various types of ink jet type recording apparatus, which are, for example, a plotter, a facsimile machine, a copying machine and the like, and liquid ejection apparatuses other than the recording apparatuses, which are, for example, a display manufacturing apparatus, an electrode manufacturing apparatus, a chip manufacturing apparatus and the like. Further, such a display manufacturing apparatus ejects solution of red (R), green (G) and blue (B) color materials from a color-material ejection head. Further, such an electrode manufacturing apparatus ejects a liquid electrode material from an electrode-material ejection head. Such a chip manufacturing apparatus ejects solution of a bio-organic material from a bio-organic material ejection head.

The entire disclosure of Japanese Patent Application No. 2012-184951, filed Aug. 24, 2012 is incorporated by reference herein.

What is claimed is:

1. A liquid ejection apparatus comprising:

a liquid ejection head that includes a plurality of nozzle groups each including at least one row of plural nozzles, and a plurality of pressure generation units each causing a pressure variation of liquid inside a pressure chamber communicated with a corresponding one of the nozzles, and that causes the pressure generation unit to eject the liquid through the corresponding one of the nozzles;

a first control unit that outputs a plurality of drive signals each including a series of at least one drive waveform, each drive waveform being used for driving one of the pressure generation units, and outputs a plurality of selection control signals each being used for control of selecting one of the at least one drive waveform included in one of the drive signals; and a second control unit that controls the liquid ejection performed by the liquid ejection head on the basis of the drive signals outputted from the first control unit and the selection control signals outputted from the first control unit, wherein the first control unit outputs the plurality of drive signals, which includes the respective series of at least one drive waveforms, the generation timing points of which are different from one another, to the second control unit, and outputs a multiplexed control signal obtained by multiplexing the selection control signals, which correspond to the respective drive signals, to the second control unit, and wherein the second control unit includes a control signal demultiplexing unit which demultiplexes the multiplexed control signal into the selection control signals corresponding to the respective nozzle groups, and a drive waveform selection unit which, on the basis of each of the demultiplexed selection control signals, selects one of the at least one drive waveform included in one of the drive signals which corresponds to the each of the demultiplexed selection control signals, and applies the selected drive waveform to one of the pressure generation units which belongs to one of the nozzle groups which corresponds to the drive signal corresponding to the each of the demultiplexed selection control signals.

2. The liquid ejection apparatus according to claim 1, wherein each of the nozzle groups is sorted into one of ranks in accordance with a flight velocity of liquid ejected from each of nozzles belonging to the each of the nozzle groups, and wherein the first control unit outputs the plurality of drive signals each including the at least one drive waveform, the generation timing of which is set so as to be specific to one of the ranks, and outputs the plurality of selection control signals each corresponding to one of the drive signals corresponding to the respective ranks.

3. A control method for a liquid ejection apparatus that includes a liquid ejection head that includes a plurality of nozzle groups each including at least one row of plural nozzles, and a plurality of pressure generation units each causing a pressure variation of liquid inside a pressure chamber communicated with a corresponding one of the nozzles, and that causes the pressure generation unit to eject the liquid through the corresponding one of the nozzles, a first control unit that outputs a plurality of drive signals each including a series of at least one drive waveform, each drive waveform being used for driving one of the pressure generation units, and outputs a plurality of selection control signals each being used for control of selecting one of the at least one drive waveform included in one of the drive signals, a second control unit that controls the liquid ejection performed by the liquid ejection head on the basis of the drive signals outputted from the first control unit and the selection control signals outputted from the first control unit, the control method comprising:

causing the first control unit to output the plurality of drive signals, which includes the respective series of at least one drive waveforms, the generation timing points of which are different from one another, to the second control unit, and output a multiplexed control signal obtained by multiplexing the selection control signals, which correspond to the respective drive signals, to the second control unit, and causing the second control unit to demultiplex the multiplexed control signal into the selection control signals corresponding to the respective nozzle groups, and on the basis of each of the demultiplexed selection control signals, select one of the at least one drive waveform included in one of the drive signals which corresponds to the each of the demultiplexed selection control signals, and apply the selected drive waveform to one of the pressure generation units which belongs to one of the nozzle groups which corresponds to the drive signal corresponding to the each of the demultiplexed selection control signals.

* * * * *